US005388799A

United States Patent [19]

Keefe

[11] Patent Number: 5,388,799

[45] Date of Patent: Feb. 14, 1995

[54] CHRISTMAS TREE STAND

[76] Inventor: Francis X. Keefe, 802 Connecticut View Dr., Oyster Bay, N.Y. 11771

[21] Appl. No.: 59,831

[22] Filed: May 10, 1993

[51] Int. Cl.[6] ..... F16M 13/00

[52] U.S. Cl. ..... 248/519; 248/523; 248/129

[58] Field of Search ..... 248/519, 523, 524, 511, 248/129; 47/40.5

[56] References Cited

U.S. PATENT DOCUMENTS

| | | | |
|---|---|---|---|
| 1,155,383 | 10/1915 | Tischer | 248/523 X |
| 1,183,508 | 5/1916 | Waterston | 248/129 X |
| 1,598,016 | 12/1923 | Runser . | |
| 1,662,091 | 3/1928 | Vuozzo | 248/524 |
| 1,873,693 | 8/1932 | Whitfield et al. | 248/524 |
| 2,424,818 | 2/1946 | Gustafson . | |
| 2,478,278 | 8/1949 | Kiesow | 248/524 |
| 2,485,081 | 6/1948 | Ahrens . | |
| 2,524,450 | 10/1950 | Knaus | 248/523 |
| 3,109,596 | 11/1963 | Chernansky | 248/519 X |
| 3,403,877 | 10/1968 | Gudmundson . | |
| 3,405,896 | 2/1967 | Eby . | |
| 3,733,040 | 5/1973 | Rocquin . | |
| 3,987,996 | 10/1976 | Yocca | 248/524 |
| 5,118,067 | 6/1992 | Gillanders | 248/527 |

FOREIGN PATENT DOCUMENTS

| | | | |
|---|---|---|---|
| 927171 | 4/1955 | Germany | 248/524 |
| 3701426 | 7/1988 | Germany | 248/523 |
| 2208591 | 4/1989 | United Kingdom | 248/523 |

*Primary Examiner*—Ramon O. Ramirez
*Assistant Examiner*—Derek J. Berger
*Attorney, Agent, or Firm*—Collard & Roe

[57] ABSTRACT

An apparatus for supporting and transporting a Christmas tree including a base having an upper surface with a center point and a lower surface with a periphery. A Christmas tree stand or other support device is disposed generally above the center point of the base for supporting the Christmas tree. A set of wheels are rotatably mounted generally about the periphery of the lower surface of the base for transporting the base. The wheels are spaced from each other to provide balanced support for the base. The wheels can be locked to prevent unintended transportation of the base. An extension member may be attached to hooks on the underside of the base for facilitating transportation of the tree.

3 Claims, 2 Drawing Sheets

CHRISTMAS TREE STAND

BACKGROUND OF THE INVENTION

1. Field of the Invention

The present invention relates to a Christmas tree stand for supporting and transporting a Christmas tree. More particularly, it relates to a Christmas tree stand with wheels that can be selectively secured in place or moved to an alternate location.

2. The Prior Art

Christmas tree stands are known according to the prior art for supporting the base of Christmas trees. U.S. Pat. No. 1,598,016 to Runser, U.S. Pat. No. 2,424,818 to Gustafson, U.S. Pat. No. 3,405,896 to Eby and U.S. Pat. No. 3,733,040 to Rocquin, all disclose stationary Christmas tree stands. However, these Christmas tree stands do not provide means for supplying water to the base of the Christmas tree. This poses a problem in that the freshly cut Christmas trees require water to maintain their needles. In addition, the gradual drying out of the Christmas tree poses a fire threat as the hot Christmas bulbs are in closed contact with the tree.

Various attempts have been made to overcome these deficiencies by providing a Christmas tree stand with a container that holds water at the base of the Christmas tree, for example, U.S. Pat. No. 2,485,081 to Ahrens and U.S. Pat. No. 3,403,877 to Gudmundson. However, these stands are limited in that they are stationary Christmas tree stands.

It would be desirable to have a Christmas tree stand which provides a container for water at the Christmas tree base and is also movable. Such a stand would be useful for rotating the tree for ease of decorating, or rolling the tree through a home or from one part of a room to another. In addition, the ability to transport a Christmas tree would be particularly useful for catering halls, offices and department stores, where decorations must be frequently changed.

SUMMARY OF THE INVENTION

It is therefore an object of the present invention to provide a Christmas tree stand that securely supports the trunk of a Christmas tree.

It is a further object of the present invention to provide a Christmas tree stand where the tree trunk is set within a container of water.

It is yet another object of the present invention to provide a Christmas tree stand that can be easily rolled along the floor.

It is still another object of the present invention to provide a Christmas tree stand which can be secured in place to prevent unintended transportation of the tree.

It is a further object of the present invention to provide a Christmas tree stand which is decorated with gift wrapping to resemble a Christmas present.

These and other related objects are achieved according to the invention by an apparatus for supporting and transporting a Christmas tree, including a base having an upper surface with a center point and a lower surface with a periphery. Support means are disposed generally above the center point of the base for supporting the Christmas tree. A plurality of wheels are rotatably mounted generally about the periphery of the lower surface for transporting the base. The plurality of wheels are spaced from each other to provide balanced support for the base. The support means may comprise a Christmas tree stand rigidly affixed to the upper surface.

The plurality of wheels are mounted equidistantly about the periphery of the lower surface. Each of the wheels includes a swivel mount so that each of the plurality of wheels can be swiveled 360° for freely transporting the apparatus in any direction. Each of these swivel mounts include recessed ball bearings. The base is circularly shaped and includes a circular perimeter.

The apparatus further includes attachment means for selectively securing the apparatus to a stationary structure to prevent unintended transporting of the apparatus and attaching the apparatus to an extension member for facilitating transportation of the apparatus. Alternatively, the apparatus may include means for aligning each of the plurality of wheels generally parallel to the closest tangent line of the circular perimeter, so that each of the plurality of wheels faces in a different direction to prevent unintended transportation of the base. The means for aligning each of the plurality of wheels includes rotating the base generally about the center point. In a further embodiment, each of the plurality of wheels includes locking means to prevent rotation of the wheels.

The apparatus further includes a plurality of side walls with tops extending generally upwardly from the upper surface of the base. A top member is supported on the tops of the side walls and includes a recess therein for receiving the Christmas tree. The support means is operatively coupled to the top member. The top member includes a plurality of slots extending generally radially toward the recess. The support means comprises a plurality of blocks with a guide pin coupled to each of the plurality of blocks. Each of the guide pins extends through a corresponding one of the slots to guide the plurality of blocks toward the recess to contact the Christmas tree. The guide pins are threaded rods and the support means include cooperatively threaded nuts to clamp the plurality of blocks to the top member.

The apparatus further includes a container mounted on the base below the recess for containing the Christmas tree and a predetermined quantity of water. The base is rectangular shaped with four corner and one of the plurality of wheels is located adjacent each corner. Each of the plurality of wheels includes a swivel mount so that the plurality of wheels can be swiveled about 360° for freely transporting the apparatus in any direction.

In an alternate embodiment, the apparatus for supporting and transporting a Christmas tree with a trunk includes a rectangular base having an upper surface with a center point, an upper periphery and a lower surface with four corners. Four side walls extend upwardly from the upper periphery, and each of the side Walls has a top. A top member is supported on the tops of the four side walls and has a circular recess formed therethrough for receiving the Christmas tree trunk. The base, the four side walls and the top member define a substantial rectangular cubical housing.

A container is mounted within the housing below the recess for containing a predetermined quantity of water and accommodating the trunk of the Christmas tree. The container, the recess and the Christmas tree trunk are generally above the base center point. The top member has four corners and four slots. Each of the slots extends radially between the recess and a corresponding one of the corners. Four support members are provided each having a top surface. Each of these support members has a pair of threaded rods mounted thereon. The rods are disposed perpendicularly to the top surface and pass through the slots so that each of the support members are slidingly disposed below a corresponding one of the slots. Four pairs of nuts threadedly engage the four pairs of threaded rods to clamp the support members to the top member in a manner whereby the support members are slidable in radial directions and releasably fixable in position to cooperatively surround and support the Christmas tree trunk.

Four wheels having locking means are rotatably mounted to the rectangular base corners for selectively transporting the housing with the Christmas tree mounted therein and retaining the Christmas tree in a desired location. The apparatus further includes a decorative wrapping placed over the substantially rectangular cubical housing, so that the cubical housing resembles a wrapped gift.

BRIEF DESCRIPTION OF THE DRAWINGS

Other objects and features of the present invention will become apparent from the following detailed description considered in connection with the accompanying drawings which discloses two embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
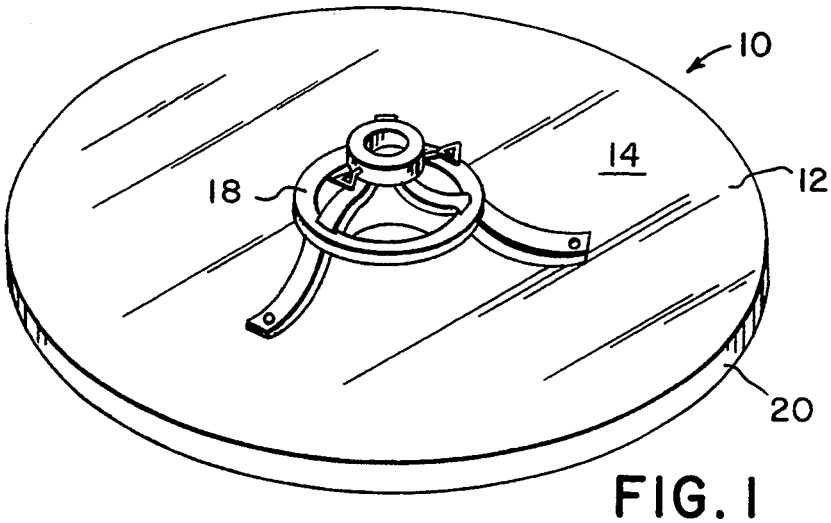
FIG. 1 is a top side perspective view of an embodiment of a Christmas tree stand according to the invention.
Figure 2:
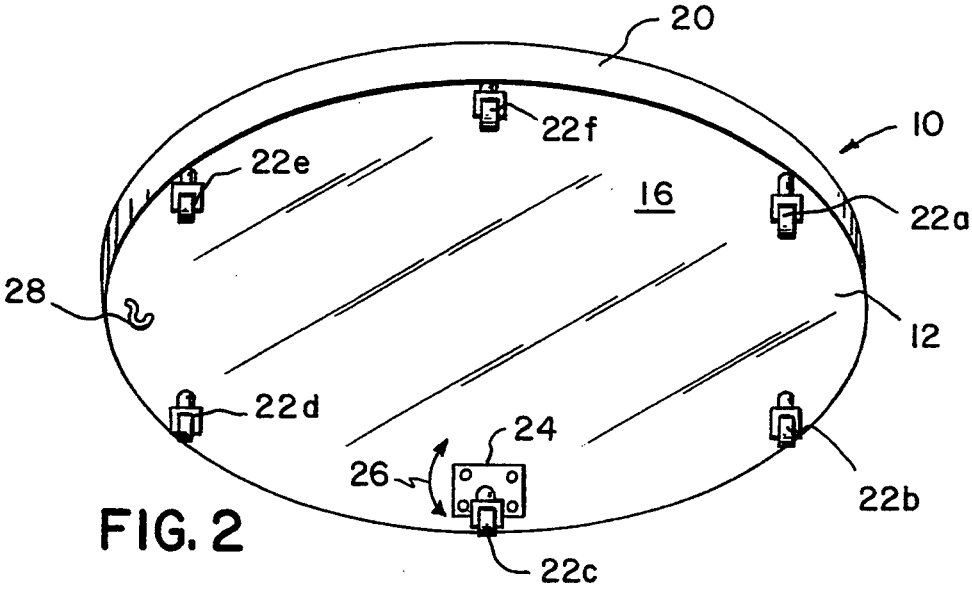
FIG. 2 is a bottom side perspective view of the Christmas tree stand.
Figure 3:
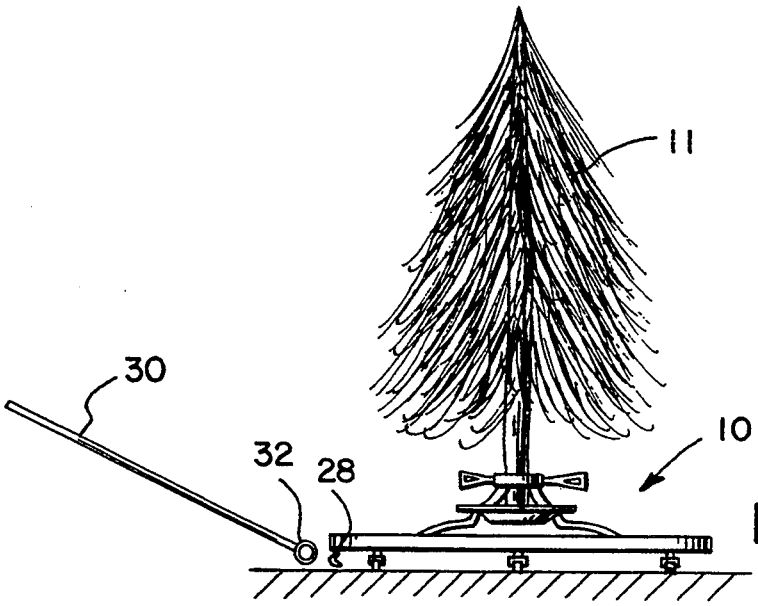
FIG. 3 is a front side elevational view of the Christmas tree stand with a Christmas tree mounted therein.

Referring now in detail to the drawings and in particular FIGS. 1, 2 and 3, there is shown an embodiment of a Christmas tree stand 10 for supporting and transporting a Christmas tree. Christmas tree stand 10 includes a base 12 with an upper surface 14 and a lower surface 16. A Christmas tree support 18 is centrally mounted on upper surface 14. Christmas tree support 18 is a conventional Christmas tree stand, for example, which is securely attached to upper surface 14. Christmas tree support 18 is equipped with a container for holding water in the vicinity of the Christmas tree base. There is a large variety of conventional Christmas tree stands with and without water containers, all of which may be mounted to base 10. Providing water for a freshly cut Christmas tree helps to extend the life of the Christmas tree and prevents it from drying out, which may present a fire hazard.

Base 12 is a rigid circular disk made from finished plywood, plastic, pressboard or recycled material, for example. Base 12 has a diameter of 30 inches and a thickness of ¾ of an inch, for example. As can be appreciated, a variety of materials may be used for base 12, having different decorative and/or structural characteristics. Base 12 may be painted or covered to prevent water damage to base 12 and to provide a visually attractive upper surface 14. Similarly an edge 20 of base 12, which is exposed, may be painted or covered. In addition, a blanket or cloth may be draped over support 18 and base 12 to completely hide it from view.

As can be seen in FIG. 2, a set of wheels 22 is mounted on lower surface 16, generally around the periphery of lower surface 16. Although six wheels **22*a*–22*f* are shown, base 12 may be equipped with as few as three wheels. Furthermore, additional wheels may be added, for example, along the periphery, at the center of lower surface 16 or at other intermediate positions if a very large tree is to be supported. Each wheel 22 is provided with a base 24, which is only shown on wheel 22*c* for the sake of clarity. Base 24 is mounted to lower surface 16 by wood screws, for example. Wheels 22 can pivot 360° in directions 26. In this manner, base 12 is easily transported in any direction regardless of the direction in which wheels 22** are initially directed.

A hook 28 is shown between wheels **22*d* and 22*e*. Although, only a single hook 28 is shown, additional hooks may be provided between other pairs of wheels. Hook 28 is used to secure Christmas tree stand 10 to a stationary object. Once Christmas tree stand 10 is in place, a rope or cord is tied between hook 28 and the nearest wall, for example. In this manner, Christmas tree stand 10** will not roll out of position if located on an uneven floor.

As can be seen in FIG. 3, in order to move Christmas tree stand 10 and Christmas tree 11 mounted thereon, a loop 32 of an extension member 30 engages hook 28. Extension member 30 is then used to drag Christmas tree stand 10 and Christmas tree 11 to its new location.

If it is not possible to secure Christmas tree stand to the nearest wall, Christmas tree stand 10 may be rotated about its center point which will cause each wheel 22 to become generally aligned parallel to the nearest tangent line of the perimeter of base 12. Thus, Christmas tree stand 10 will not roll on its own, since each wheel is pointing in a different direction.

Figure 4:
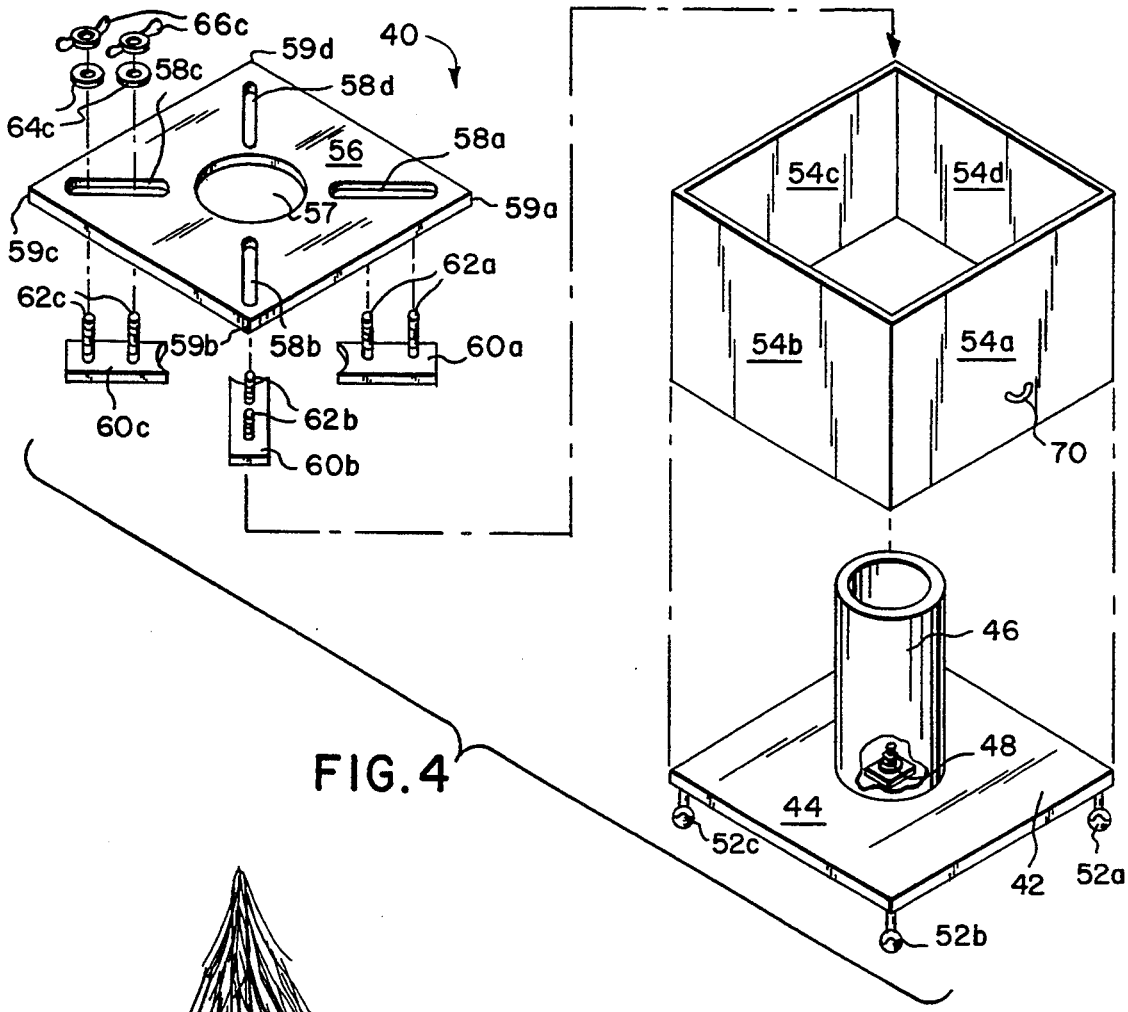
FIG. 4 is an exploded view of an alternate embodiment of a Christmas tree stand according to the invention.

Referring now to FIG. 4, there is shown an alternate embodiment of Christmas tree stand 40, including a base 42 with an upper surface 44. Centrally mounted on upper surface 44 is a container 46 for holding water. Container 46 is mounted to upper surface 44 by a nut, bolt, washer and gasket assembly 48. The bolt of assembly 48 extends upwardly through base 42 into container 46 and is designed to be received within a cooperatively sized bore extending axially into the base of the Christmas tree. A gasket is placed over the bolt and is held by a washer and one or two nuts. The gasket prevents water from leaking out of container 46. A set of wheels 52 is located in each corner of base 42, for example. Additional wheels may be placed along each side of base 42 or centrally mounted on the lower side of base 42. Wheels 52 are mounted in a manner similar to that of wheel **22*c*, shown in FIG. 2, i.e. with a mounting plate and wood screws. Wheels 52** are pivotable about 360° and are ideally equipped with recessed ball bearings.

Side boards 54 are mounted on upper surface 44 and extend upwardly approximately the same height as container 46. A top member 56 rests on the top edges of sides 54 to form a substantially rectangular cubical housing. Top member 56 includes a circular recess 57 disposed approximately in the center of top member 56.

Four slots 58 extend radially between circular recess 57 and corners 59 of top member 56.

Support members 60 are each provided with a pair of threaded rods 62 which extend through slots 58. Washers 64 and correspondingly threaded wing nuts 66 engage threaded rods 62 adjacent the upper surface of top member 56. Support members 60 can be slid radially along slots 58. Support members 60 are retracted to corners 59 in order to place the tree trunk through circular recess 57 into container 46. A bore is formed in the bottom of the Christmas tree trunk in order to receive bolt 48. In this manner, the bottom of the Christmas tree trunk is retained in position. Support members 60 are then slid radially towards the Christmas tree trunk. Once support members 60 engage the four sides of the Christmas tree trunk, wing nuts 66 are tightened in order to support the Christmas tree.

Figure 5:
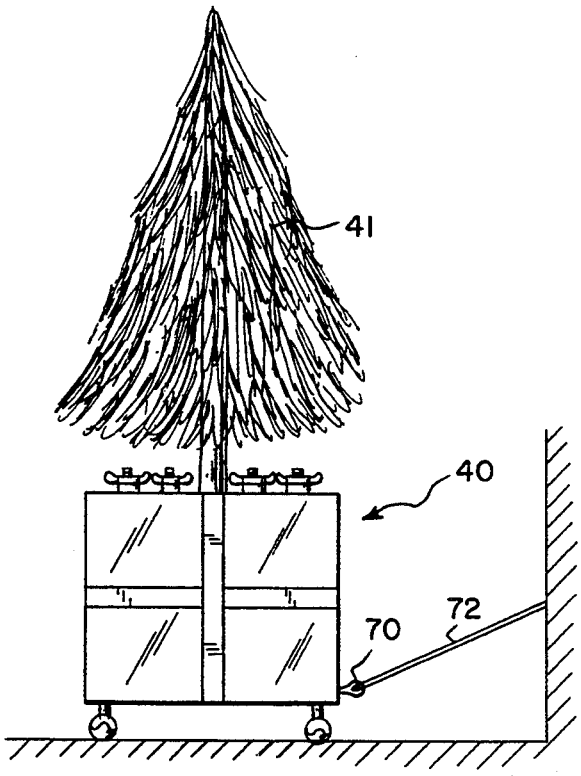
FIG. 5 is a front side elevational view of the Christmas tree stand with a Christmas tree mounted therein.

As can be seen in FIG. 5, sides 54 may be covered with a decorative wrapping to resemble a large Christmas present with Christmas tree 41 extending upwardly therefrom. A hook 70 is provided on a side or bottom of Christmas tree stand 40. A cable 72 may be attached to hook 70 to attach Christmas tree stand 40 to a stationary object to prevent unintended movement of the Christmas tree stand 40. Alternatively, an extension rod may be connected to hook 70 to facilitate moving of the Christmas tree stand 40 and Christmas tree 41.

While several embodiments of the present invention have been shown and described, it is to be understood that many changes and modifications may be made thereunto without departing from the spirit and scope of the invention as defined in the appended claims.

What is claimed is:

1. An apparatus for supporting and transporting a Christmas tree with a Christmas tree stand, comprising:

a circular base having an upper surface with a center point and a lower surface with a circular periphery;

the Christmas tree stand rigidly affixed to said upper surface above the center point for supporting the Christmas tree;

a plurality of wheels rotatably mounted on said lower surface for transporting said base, said plurality of wheels being equally spaced from each other around the circular periphery to provide balanced support for said base; and attachment means comprising a downwardly extending hook mounted along the circular periphery of said lower surface equidistantly between two adjacent wheels, said attachment means attaching said base to one of:

(i) a stationary structure to prevent unintended transportation of the Christmas tree;

(ii) an extension member for facilitating rolling of the Christmas tree; and (iii) an extension member for rotating the base about its center point to align each of the wheels to the closest tangent line of the circular periphery, so that each of the wheels faces a different direction to prevent unintended transportation of the Christmas tree.

2. The apparatus according to claim 1, wherein said circular base has a diameter of 30 inches and a thickness of $\frac{3}{4}$ inch.

3. The apparatus according to claim 2, wherein each of said plurality of wheels includes a swivel mount so that each of said plurality of wheels can be swiveled 360° for freely transporting the apparatus in any direction.

* * * * *